US011796956B2

(12) United States Patent
Shiokawa et al.

(10) Patent No.: US 11,796,956 B2
(45) Date of Patent: Oct. 24, 2023

(54) ROTATION TRANSMISSION STRUCTURE AND IMAGE FORMING APPARATUS

(71) Applicant: FUJIFILM Business Innovation Corp., Tokyo (JP)

(72) Inventors: Yuya Shiokawa, Kanagawa (JP); Daisuke Ishihara, Kanagawa (JP); Kohei Tachibana, Kanagawa (JP)

(73) Assignee: FUJIFILM Business Innovation Corp., Tokyo (JP)

( * ) Notice: Subject to any disclaimer, the term of this patent is extended or adjusted under 35 U.S.C. 154(b) by 0 days.

(21) Appl. No.: 17/869,741

(22) Filed: Jul. 20, 2022

(65) Prior Publication Data

US 2023/0305477 A1 Sep. 28, 2023

(30) Foreign Application Priority Data

Mar. 25, 2022 (JP) ..... 2022-050815

(51) Int. Cl.
*G03G 15/00* (2006.01)
*G03G 21/18* (2006.01)
*G03G 21/16* (2006.01)

(52) U.S. Cl.
CPC ..... *G03G 15/757* (2013.01); *G03G 21/1647* (2013.01); *G03G 21/1857* (2013.01); *G03G 2221/1657* (2013.01)

(58) Field of Classification Search
CPC ..... G03G 15/757; G03G 21/1647; G03G 21/1857; G03G 2221/1657
See application file for complete search history.

(56) References Cited

U.S. PATENT DOCUMENTS 6,968,144 B2 * 11/2005 Mizoguchi ..... F16D 11/14 399/167
9,529,315 B1 * 12/2016 Kawai ..... G03G 21/1647
9,541,884 B1 1/2017 Kawai
2001/0008590 A1 * 7/2001 Katada ..... G03G 15/757 399/167
2003/0059233 A1 * 3/2003 Jang ..... F16D 1/101 399/167

(Continued)

FOREIGN PATENT DOCUMENTS

JP 2009115922 5/2009
JP 2016157606 9/2016
JP 2017048922 3/2017

*Primary Examiner* — Francis C Gray
(74) *Attorney, Agent, or Firm* — JCIPRNET

(57) ABSTRACT

A rotation transmission structure includes: a first member that is provided on a rotating body and includes a plural straight teeth extending in an axial direction of the rotating body and arranged in a circumferential direction; a second member that is provided on a moving body moving in the axial direction of the rotating body, includes a plural straight teeth extending in the axial direction of the rotating body and arranged in the circumferential direction, and is fitted to the first member to transmit rotation of the rotating body to the moving body in a case where the moving body approaches the rotating body; a biasing member that biases the first member toward the moving body; and a rotation mechanism that is provided between the first member and the rotating body and rotates the first member in a case where the first member is moved toward the rotating body.

12 Claims, 5 Drawing Sheets

(56) References Cited

U.S. PATENT DOCUMENTS

2015/0240879 A1* 8/2015 Takagi ..... F16H 55/17
464/154
2017/0017192 A1* 1/2017 Sakurai ..... G03G 21/1647

* cited by examiner

ROTATION TRANSMISSION STRUCTURE AND IMAGE FORMING APPARATUS

CROSS-REFERENCE TO RELATED APPLICATIONS

This application is based on and claims priority under 35 USC 119 from Japanese Patent Application No. 2022-050815 filed Mar. 25, 2022.

BACKGROUND

(i) Technical Field

The present disclosure relates to a rotation transmission structure and an image forming apparatus.

(ii) Related Art

JP2009-115922A and JP2017-48922A disclose image forming apparatuses having a configuration where rotation of a rotating body can be transmitted to a moving body in a case where the moving body is moved in an axial direction of the rotating body.

SUMMARY

In the configuration where the rotation of the rotating body can be transmitted to the moving body in a case where the moving body is moved in the axial direction of the rotating body, a force required for fitting between a first member and a second member, each of which includes a plurality of straight teeth extending in the axial direction of the rotating body and arranged in a circumferential direction, is increased in a case where the positions of the straight teeth of the first member in the circumferential direction coincide with the positions of the straight teeth of the second member in the circumferential direction.

Aspects of non-limiting embodiments of the present disclosure relate to a rotation transmission structure and an image forming apparatus that a force required for fitting between a first member and a second member can be reduced as compared to a configuration where the first member is movable only in a biasing direction of a biasing member and a direction opposite to the biasing direction.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided a rotation transmission structure including: a first member that is provided on a rotating body and includes a plurality of straight teeth extending in an axial direction of the rotating body and arranged in a circumferential direction; a second member that is provided on a moving body moving in the axial direction of the rotating body, includes a plurality of straight teeth extending in the axial direction of the rotating body and arranged in the circumferential direction, and is fitted to the first member to transmit rotation of the rotating body to the moving body in a case where the moving body approaches the rotating body; a biasing member that biases the first member toward the moving body; and a rotation mechanism that is provided between the first member and the rotating body and rotates the first member in a case where the first member is moved toward the rotating body.

BRIEF DESCRIPTION OF THE DRAWINGS

Exemplary embodiment(s) of the present invention will be described in detail based on the following figures, wherein.

DETAILED DESCRIPTION

Figure 1:
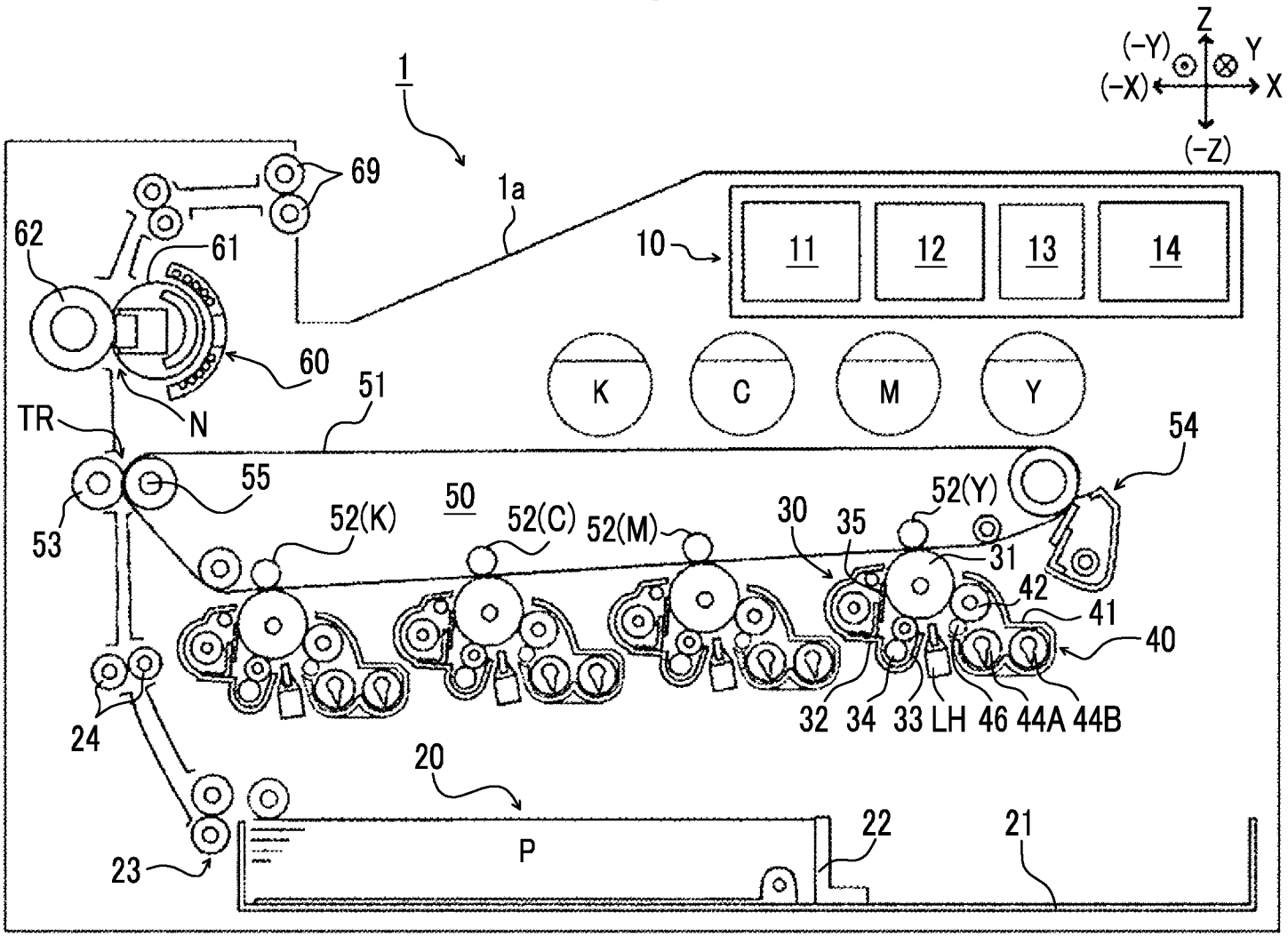
FIG. 1 is a cross-sectional view showing the internal configuration of an image forming apparatus according to an exemplary embodiment of the present disclosure.

An image forming apparatus 1 according to an exemplary embodiment of the present disclosure will be described with reference to FIGS. 1 to 5.

The present disclosure will be described in more detail below using exemplary embodiments and specific examples, but the present disclosure is not limited to these exemplary embodiments and specific examples.

Further, it should be noted in the description using the following drawings that the drawings are schematic and the ratio and the like of each dimension are different from the actual ratio, and members other than members necessary for description will be appropriately omitted for easy understanding.

In order to facilitate the understanding of the following description, in the drawings, a front-rear direction is referred to as an X-axis direction, a left-right direction is referred to as a Y-axis direction, and an up-down direction is referred to as a Z-axis direction.

Overall Configuration and Operation of Image Forming Apparatus

FIG. 1 is a schematic cross-sectional view showing the internal configuration of the image forming apparatus 1 according to this exemplary embodiment.

The overall configuration and operation of the image forming apparatus 1 will be described below with reference to the drawings.

The image forming apparatus 1 includes: a control device 10; a sheet feeding device 20; photoreceptor units 30 corresponding to four colors of yellow (Y), magenta (M), cyan (C), and black (K); developing devices 40 corresponding to the four colors; a transfer device 50; and a fixing device 60. A discharge tray 1*a* where a sheet on which an image is recorded is discharged and stored is formed on the upper surface (Z direction) of the image forming apparatus 1.

The control device 10 includes an image forming apparatus controller 11 that controls the operation of the image forming apparatus 1, a controller unit 12 that prepares image data corresponding to a printing processing request, an exposure controller 13 that controls the lighting of exposure devices LH, a power supply device 14, and the like. The power supply device 14 applies a high voltage to charging rollers 32, developing rollers 42, primary transfer rollers 52, a secondary transfer roller 53, and the like to be described later and supplies power to the exposure devices LH, the sheet feeding device 20, the fixing device 60, each sensor to be provided, and the like.

The controller unit 12 converts print information, which is input from an external information transmission device (for example, a personal computer or the like), into image information for the formation of a latent image and outputs a drive signal to the exposure device LH at a preset timing. The exposure device LH of this exemplary embodiment is formed of a LED head in which a plurality of light emitting diodes (LEDs) are linearly arranged in a main scanning direction.

The sheet feeding device 20 is provided at the bottom of the image forming apparatus 1. The sheet feeding device 20 includes a sheet loading plate 21, and sheets P as a plurality of recording mediums are loaded on the upper surface of the sheet loading plate 21. The sheets P, which are loaded on the sheet loading plate 21 and are positioned in a width direction by a regulation plate (not shown), are drawn forward (−X direction) one by one from above by a sheet drawing unit 22 and are then transported to a nip portion between a pair of registration rollers 23.

The respective photoreceptor units 30 corresponding to the four colors are provided in parallel above the sheet feeding device 20 (Z direction). Each of the photoreceptor units 30 includes a photoreceptor drum 31 that is rotationally driven through an output gear 122 (not shown in FIG. 1. See FIGS. 2A and 2B) provided in a drive mechanism including a drive motor M1 (not shown in FIG. 1. See FIGS. 2A and 2B) and the like. The drive motor M1 of this exemplary embodiment is an example of a drive source of the present disclosure, the output gear 122 is an example of a rotating body of the present disclosure, and the photoreceptor drum 31 is an example of a moving body of the present disclosure.

The charging roller 32, the exposure device LH, the developing device 40, the primary transfer roller 52, and a cleaning blade 34 are arranged in the rotation direction of the photoreceptor drum 31. A cleaning roller 33, which cleans the surface of the charging roller 32, is disposed to face and be in contact with the charging roller 32.

Each of the developing devices 40 includes a developing housing 41 in which a developer is stored. A developing roller 42 that is disposed in contact with the photoreceptor drum 31 and is rotationally driven through a rotation transmission structure 100 and a pair of transport augers 44A and 44B that is disposed on the diagonally lower side in the rear of the developing roller 42 and agitates the developer and transports the developer to the developing roller 42 are provided in the developing housing 41. A layer thickness-regulating member 46, which regulates the layer thickness of the developer, is disposed close to the developing roller 42.

The respective developing devices 40 have substantially the same configuration except for developers stored in the developing housings 41, and form toner images of yellow (Y), magenta (M), cyan (C), and black (K), respectively.

The surface of the rotating photoreceptor drum 31 is charged by the charging roller 32, and an electrostatic latent image is formed on the surface of the rotating photoreceptor drum 31 by latent image-forming light emitted from the exposure device LH. The electrostatic latent image formed on the photoreceptor drum 31 is developed as a toner image by the developing roller 42.

The transfer device 50 includes an intermediate transfer belt 51 onto which the respective color toner images formed on the photoreceptor drums 31 of the respective photoreceptor units 30 are multiply transferred while the intermediate transfer belt 51 receives rotational drive from the transfer drive roller 55 and moves to be circled, and the primary transfer rollers 52 that sequentially transfer (primarily transfer) the respective color toner images formed on the respective photoreceptor units 30 onto the intermediate transfer belt 51. The transfer device 50 further includes: the secondary transfer roller 53 that collectively transfer (secondarily transfer) the respective color toner images, which are transferred onto the intermediate transfer belt 51 so as to be superimposed, to a sheet P used as a recording medium; and an intermediate transfer belt cleaner 54 that removes residual toner adhering to the intermediate transfer belt 51.

The respective color toner images formed on the photoreceptor drums 31 of the respective photoreceptor units 30 are sequentially electrostatically transferred (primarily transferred) onto the intermediate transfer belt 51 by the primary transfer rollers 52 to which a predetermined transfer voltage is applied from the power supply device 14 or the like controlled by the image forming apparatus controller 11, so that a superimposed toner image in which the respective color toners are superimposed is formed.

The superimposed toner image formed on the intermediate transfer belt 51 is transported to a region (secondary transfer portion TR) in which the secondary transfer roller 53 is disposed as the intermediate transfer belt 51 is moved. In a case where the superimposed toner image is transported to the secondary transfer portion TR, a sheet P is supplied to the secondary transfer portion TR from the sheet feeding device 20 at that timing. Then, a predetermined transfer voltage is applied to the secondary transfer roller 53 from the power supply device 14 or the like controlled by the image forming apparatus controller 11, so that the toner images multiply transferred onto the intermediate transfer belt 51 are collectively transferred to the sheet P which is sent from the pair of registration rollers 23 and is guided by a transport guide.

Residual toner on the surface of the photoreceptor drum 31 is removed by the cleaning blade 34 and is collected in a waste toner collecting container (not shown). The surface of the photoreceptor drum 31 is recharged by the charging roller 32. Residues, which cannot be completely removed by the cleaning blade 34 and adhere to the charging roller 32, are captured and accumulated on the surface of the cleaning roller 33 that is rotated in contact with the charging roller 32.

The fixing device 60 includes a heating module 61 and a pressurization module 62, and a fixing nip portion N (fixing region) is formed by a pressure contact region between the heating module 61 and the pressurization module 62.

The sheet P to which the toner image is transferred in the transfer device 50 is transported to the fixing device 60 via the transport guide in a state where the toner image is not fixed. The toner image is fixed to the sheet P, which is transported to the fixing device 60, with the action of pressing and heating by a pair of the heating module 61 and the pressurization module 62.

The sheet P on which the fixed toner image is formed is discharged from a pair of discharge rollers 69 to the discharge tray 1*a* that is formed on the upper surface of the image forming apparatus 1.

The configuration of the rotation transmission structure 100 according to this exemplary embodiment will be described below with reference to the drawings.

The photoreceptor drum 31 is adapted to be mounted on the apparatus body from the front surface side of the apparatus body along a guide rail (not shown), and is connected to the apparatus body at a predetermined position so as to receive rotational drive from an apparatus body side.

The image forming apparatus 1 includes the rotation transmission structure 100 that transmits rotational drive to the photoreceptor drum 31 from the apparatus body.

Figure 2A:
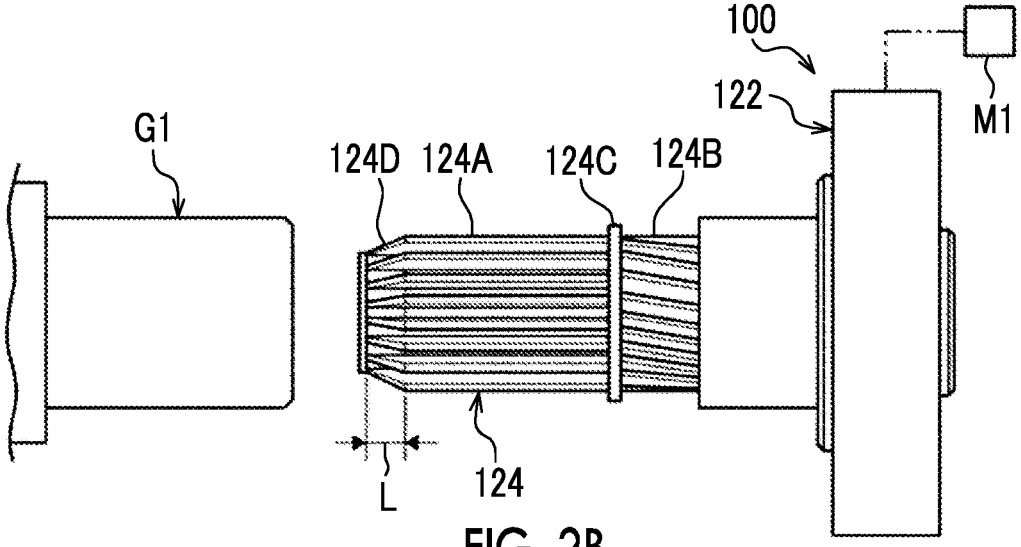
FIG. 2A is a side view showing a state where a gear of a photoreceptor drum according to the exemplary embodiment of the present disclosure and an output gear provided on an apparatus body side are not yet connected to each other.

As shown in FIG. 2A, the rotation transmission structure 100 includes the output gear 122 that is provided on an apparatus body side thereof and applies a rotational drive force to the photoreceptor drum 31 of the photoreceptor unit 30. Further, the rotation transmission structure 100 includes a gear G1 that is provided on the photoreceptor drum 31 so as to be rotatable integrally, and an external gear shaft 124 that is fitted to the output gear 122 and the gear G1 so that the output gear 122 and the gear G1 can transmit rotation and be separated from each other in an axial direction.

The output gear 122 is driven from the drive motor M1 serving as a drive source provided in the apparatus body via a plurality of stages of gears (not shown). The output gear 122 is provided with the external gear shaft 124 that protrudes coaxially with the output gear 122. The external gear shaft 124 is an example of a first member and an externally toothed member of the present disclosure.

Figure 2B:
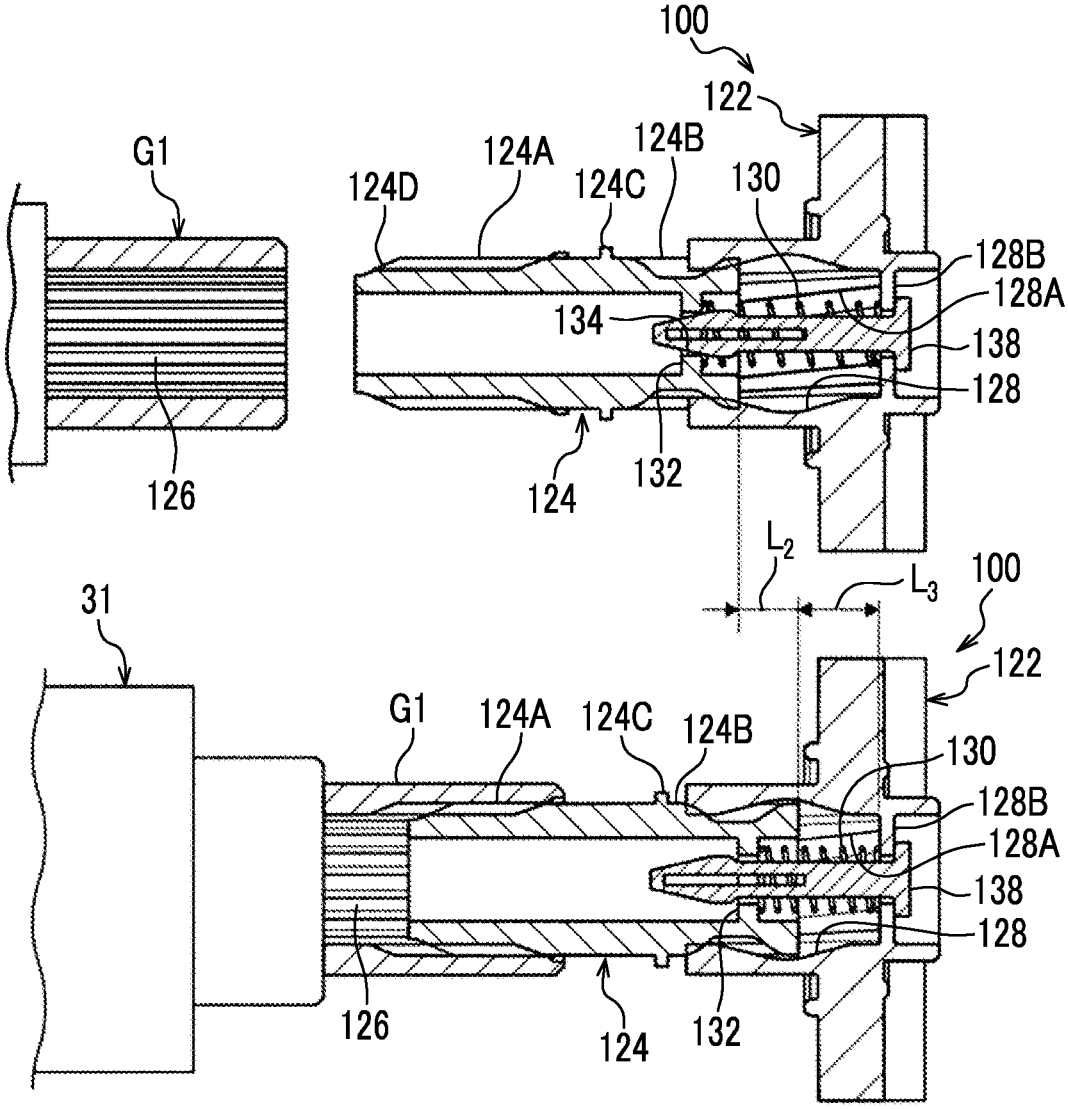
FIG. 2B is a cross-sectional view showing a state where the gear of the photoreceptor drum according to the exemplary embodiment of the present disclosure and the output gear are not yet connected to each other and a state where the gear of the photoreceptor drum and the output gear are connected to each other.

As shown in FIGS. 2A and 2B, the external gear shaft 124 includes a plurality of straight external teeth 124A that are provided on a side thereof opposite to the apparatus body side to extend in the axial direction of the output gear 122 and to be arranged in the circumferential direction. Further, the external gear shaft 124 includes a plurality of inclined external teeth 124B that are provided on an apparatus body side thereof to be inclined with respect to the axial direction and to be arranged in the circumferential direction. Furthermore, the external gear shaft 124 includes a flange 124C between the straight external teeth 124A and the inclined external teeth 124B. The straight external teeth 124A are an example of straight teeth of the first member.

The gear G1 includes a plurality of straight internal teeth 126 that are provided on the inner periphery of a cylindrical portion to extend in the axial direction of the gear G1 and to be arranged in the circumferential direction. The gear G1 of this exemplary embodiment is an example of a second member of the present disclosure, and the straight internal teeth 126 are an example of straight teeth of the second member. The number and pitch circle of the straight internal teeth 126 of the gear G1 are equal to the number and pitch circle of the straight external teeth 124A of the external gear shaft 124. As shown in a lower drawing of FIG. 2B, the straight external teeth 124A of the external gear shaft 124 mesh with the straight internal teeth 126 of the gear G1 and transmit the rotational drive force of the drive motor M1 to the photoreceptor drum 31.

Figure 3:
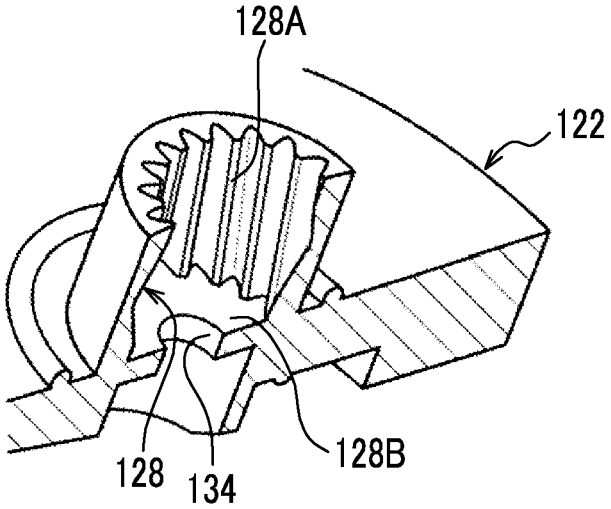
FIG. 3 is a perspective view showing the cross section of a part of the output gear.

As shown in FIGS. 2B and 3, an internal toothed hole 128 in which a plurality of inclined internal teeth 128A are formed is formed at the axial center portion of the output gear 122. The internal toothed hole 128 includes a bottom 128B on an apparatus body side thereof, and a side thereof opposite to the apparatus body side is open. The inclined internal teeth 128A of this exemplary embodiment are an example of inclined teeth provided in an internally toothed member of the present disclosure.

The number and pitch circle of the inclined external teeth 124B of the external gear shaft 124 are equal to the number and pitch circle of the inclined internal teeth 128A, and the inclined external teeth 124B of the external gear shaft 124 always mesh with the inclined internal teeth 128A of the internal toothed hole 128 as shown in FIG. 2B in a state where the inclined external teeth 124B are movable relative to the inclined internal teeth 128A in the axial direction. The inclined external teeth 124B and the inclined internal teeth 128A of this exemplary embodiment are inclined so that an axial force in a direction protruding from the internal toothed hole 128 acts on the external gear shaft 124 in a case where the output gear 122 is rotated. The inclined external teeth 124B of the external gear shaft 124 and the inclined internal teeth 128A of the output gear 122 of this exemplary embodiment are an example of a rotation mechanism of the present disclosure.

A coil spring 130 as an example of a biasing member is disposed in the internal toothed hole 128, and the coil spring 130 biases the external gear shaft 124 in a direction protruding from the internal toothed hole 128.

The external gear shaft 124 is formed in a cylindrical shape, and a wall 132 is provided in the middle portion of a hole. A guide pin 138 is provided to be inserted into a hole 134 formed in this wall 132 and a hole 136 formed in the bottom 128B of the internal toothed hole 128. A stopper (not shown) is provided so that the external gear shaft 124 biased by the coil spring 130 does not fall off from the internal toothed hole 128 of the output gear 122.

The rotation transmission structure 100 described above is adapted so that the gear G1 and the external gear shaft 124 are fitted to each other and the straight internal teeth 126 and the straight external teeth 124A mesh with each other in a case where the photoreceptor drum 31 is moved to the apparatus body side from a state shown in an upper drawing of FIG. 2B where the gear G1 and the external gear shaft 124 are separated from each other. Specifically, in this exemplary embodiment, the external gear shaft 124 is adapted to be rotated by the ½ pitch of the straight external teeth 124A with a stroke S until the flange 124C comes into contact with the end surface of the output gear 122 in a case where the external gear shaft 124 is moved to the apparatus body side in the axial direction. The gear G1 and the external gear shaft 124 are adapted to be fitted to each other regardless of the positions of the straight internal teeth 126 of the gear G1 and the straight external teeth 124A of the external gear shaft 124 in the circumferential direction since the straight external teeth 124A are rotated.

Figure 4A:
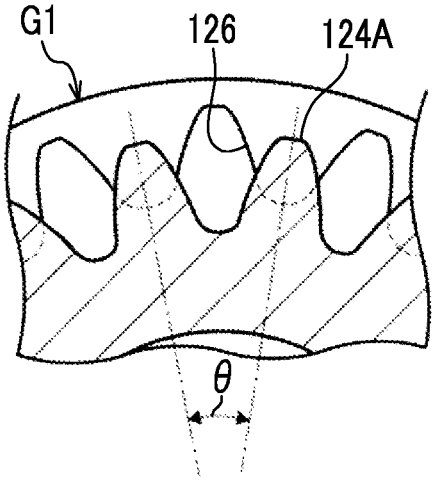
FIGS. 4A and 4B are cross-sectional views of a gear of a photoreceptor and straight external teeth of an external gear shaft as viewed in an axial direction.

Here, the pitch of the straight external teeth 124A is a central angle θ between the straight external teeth 124A adjacent to each other in the circumferential direction as shown in FIG. 4A. This central angle θ is equivalent to a central angle θ between the straight internal teeth 126 adjacent to each other in the circumferential direction. The pitch of the straight external teeth 124A may be regarded as a length that is obtained in a case where a pitch circumference is divided by the number of teeth.

A tapered portion 124D having the shape of a chamfer, of which the length in the axial direction is L, is formed at the corner of a distal end of the external gear shaft 124 of this exemplary embodiment.

Action and Effects

First, a drive force transmission device 200 according to a comparative example will be described with reference to FIGS. 6A and 6B prior to the description of the action and effects of the rotation transmission structure 100 according to this exemplary embodiment. The same components of the drive force transmission device 200 shown in FIGS. 6A and 6B as the components of this exemplary embodiment will be denoted by the same reference numerals as the reference numerals of this exemplary embodiment, and the description thereof will be omitted.

Figure 6A:
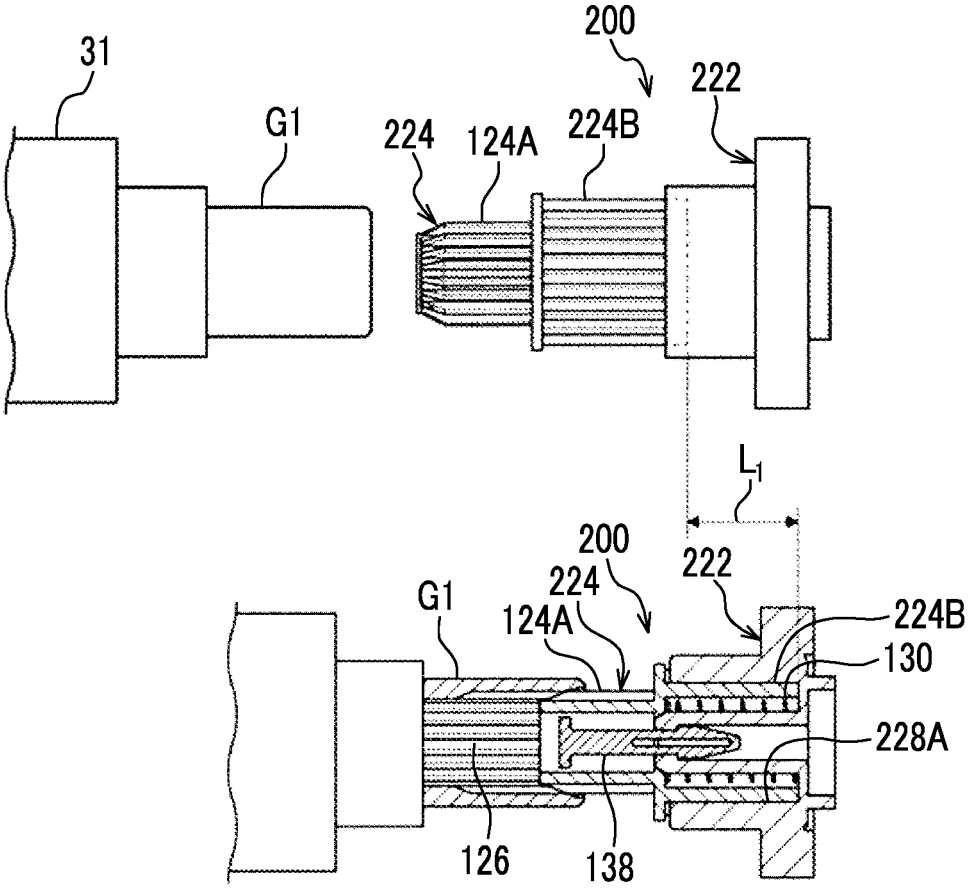
FIG. 6A is a cross-sectional view showing a state where a gear of a photoreceptor drum according to a comparative example is not yet moved to an output gear provided on an apparatus body side and FIG. 6B is a side view showing a state where the gear of the photoreceptor drum according to the comparative example and the output gear have been completely connected to each other.
Figure 6B:
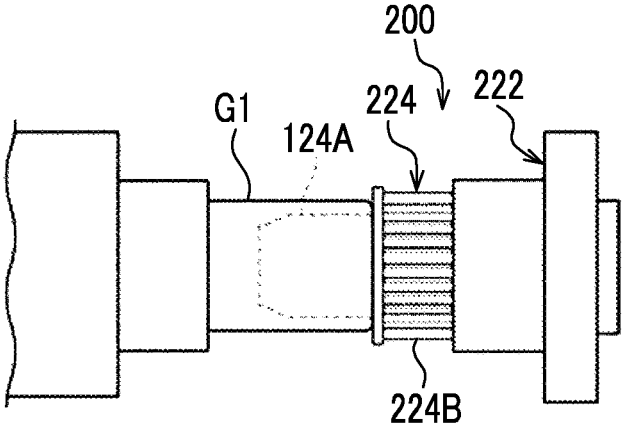

Action of Drive Force Transmission Device 200 According to Comparative Example As shown in FIGS. 6A and 6B, the configuration of an external gear shaft 224 and an output gear 222 of the drive force transmission device 200 according to the comparative example is different from the configuration of the external gear shaft 124 and the output gear 122 of the exemplary embodiment.

The external gear shaft 224 is different from the external gear shaft 124 of the exemplary embodiment in that the external gear shaft 224 includes a plurality of straight external teeth 224B on an apparatus body side thereof. Further, the output gear 222 is different from the output gear 122 of the exemplary embodiment in that a plurality of straight internal teeth 228A are provided in an internal toothed hole 128 of the output gear 222. Accordingly, in a case where the external gear shaft 224 is pushed to the apparatus body side, the external gear shaft 224 compresses a coil spring 130 without rotating.

In a case where the gear G1 of the photoreceptor drum 31 is to be connected to the external gear shaft 224 of the output gear 222 in the drive force transmission device 200 according to the comparative example, the photoreceptor drum 31 is moved toward the output gear 222 so that the gear G1 of the photoreceptor drum 31 is coaxial with the external gear shaft 224 of the output gear 222.

Figure 4B:
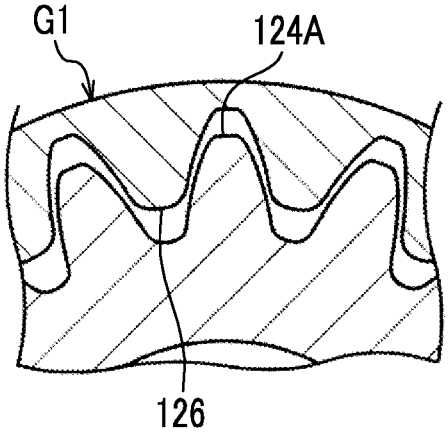

At this time, in a case where each of the straight internal teeth 126 of the gear G1 faces a valley portion between the straight external teeth 124A and 124A of the external gear shaft 224, each of the straight internal teeth 126 of the gear G1 can be made to enter the valley portion between the straight external teeth 124A and 124A of the external gear shaft 224 as shown in FIG. 4B, so that the gear G1 and the external gear shaft 224 can be fitted to each other. Accordingly, the rotational drive force of the drive motor M1 can be transmitted to the photoreceptor drum 31.

However, in a case where the photoreceptor drum 31 is to be moved toward the output gear 222 in the drive force transmission device 200 according to the comparative example and the straight internal teeth 126 of the gear G1 and the straight external teeth 124A of the external gear shaft 224 face each other as shown in FIG. 4A, the external gear shaft 224 is pushed to the apparatus body side in a state where longitudinal end portions of the straight internal teeth 126 of the gear G1 are in contact with longitudinal end portions of the external gear shaft 224 as shown in a lower drawing of FIG. 6A. For this reason, since the axial moving distance (push distance) $L_1$ of the external gear shaft 224, that is, the compression length $L_1$ of the coil spring 130 is increased, a large operation force is required. In a state shown in the lower drawing of FIG. 6A, the external gear shaft 224 is merely pushed against the output gear 222 and the gear G1 and the external gear shaft 224 are not fitted to each other. That is, in a case where the straight internal teeth 126 of the gear G1 and the straight external teeth 124A of the external gear shaft 224 face each other in the drive force transmission device 200 according to the comparative example, the gear G1 and the external gear shaft 224 are not fitted to each other even though the external gear shaft 224 is pushed to the maximum.

After that, in a case where the output gear 222 of the image forming apparatus 1 is rotationally driven, the external gear shaft 224 is rotated and each of the straight internal teeth 126 of the gear G1 and a valley portion between the straight external teeth 124A and 124A of the external gear shaft 224 face each other. Accordingly, the external gear shaft 224 obtaining the biasing force of the coil spring 130 is moved to the gear G1 and the gear G1 and the external gear shaft 224 are fitted to each other as shown in FIG. 4B, so that the rotational drive force is transmitted to the photoreceptor drum 31.

Figure 5:
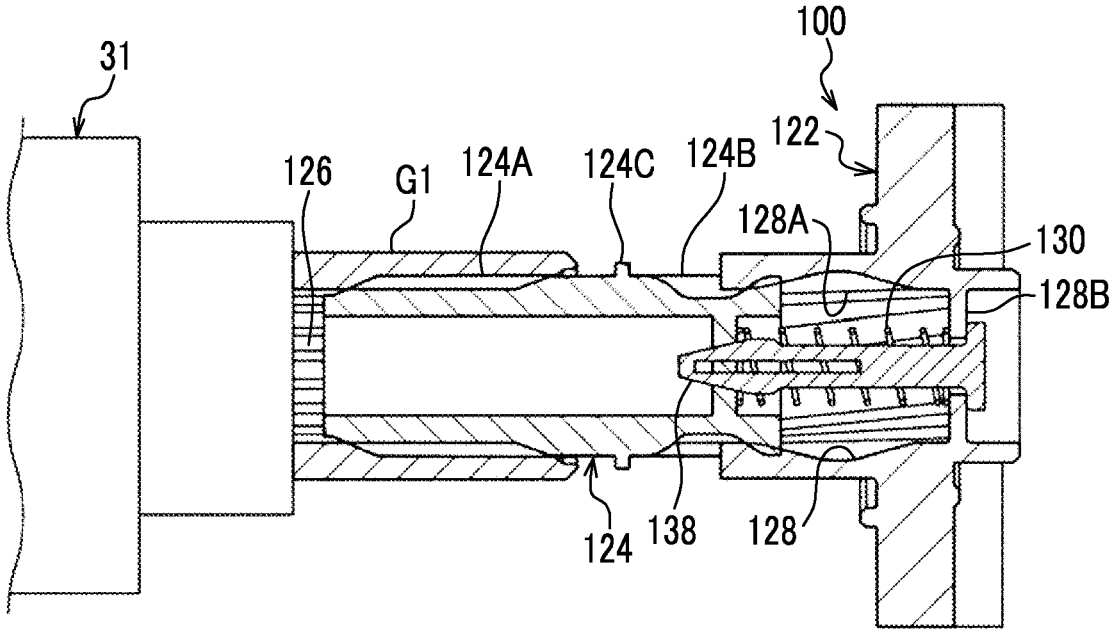
FIG. 5 is a cross-sectional view showing a state where the photoreceptor drum according to the exemplary embodiment of the present disclosure and the output gear have been completely connected to each other.

Action of Rotation Transmission Structure 100 According to Exemplary Embodiment Next, the action of the rotation transmission structure 100 according to this exemplary embodiment will be described with reference to FIGS. 2A, 2B, and 5.

Since the inclined external teeth 124B of the external gear shaft 124 of this exemplary embodiment mesh with the inclined internal teeth 128A of the output gear 222 as shown in FIGS. 2A and 2B, the external gear shaft 124 is rotated in a case where the external gear shaft 124 is moved in the axial direction.

In a case where the photoreceptor drum 31 is moved toward the output gear 122 in a state where the straight internal teeth 126 of the gear G1 and the straight external teeth 124A of the external gear shaft 124 face each other as shown in FIG. 4A in the rotation transmission structure 100 according to this exemplary embodiment, the external gear shaft 124 pushed by the gear G1 is rotated while being moved to the apparatus body side. Then, in a case where the external gear shaft 124 is rotated by the ½ pitch of the straight external teeth 124A, each of the straight external teeth 124A of the external gear shaft 124 coincides with a valley portion between the straight internal teeth 126 and 126 of the gear G1 as shown in FIG. 4B and the external gear shaft 124 biased by the coil spring 130 is fitted to the gear G1 as shown in FIG. 5.

Accordingly, poor fitting between the external gear shaft 124 and the gear G1 is suppressed as compared to a case where the straight external teeth 124A of the external gear shaft 124 are rotated by only a ¼ pitch as the external gear shaft 124 is moved in the axial direction.

For example, in a case where the number of the straight external teeth 124A of the external gear shaft 124 is 18 and at least the external gear shaft 124 is rotated by 10°, the external gear shaft 124 is fitted to the gear G1. For example, in a case where the number of the straight external teeth 124A is 18 and the twist angle of each of the inclined internal teeth 128A is 20°, the axial moving distance of the external gear shaft 124 (a dimension $L_2$ in FIG. 2B) is 5 mm at a module of 1 and the axial moving distance of the external gear shaft 124 (a dimension $L_2$ in FIG. 2B) is 4 mm at a module of 0.8, so that the external gear shaft 124 and the gear G1 can be fitted to each other with a shorter axial moving distance ($L_2$).

As described above, in the rotation transmission structure 100 according to this exemplary embodiment, the external gear shaft 124 is rotated and the external gear shaft 124 and the gear G1 are fitted to each other in a case where the external gear shaft 124 is pushed by an axial moving distance $L_2$ (<the stroke S) shorter than the axial moving distance (push distance) $L_1$ of the external gear shaft 224 of the comparative example. Accordingly, since the compression length of the coil spring 130 is reduced, the reaction force of the coil spring 130 is reduced. As a result, a force required to fit the external gear shaft 124 to the gear G1 may be reduced. Therefore, an operation force, which is required to move the photoreceptor drum 31 toward the output gear 122, in the rotation transmission structure 100 according to this exemplary embodiment may be reduced as compared to that in the drive force transmission device 200 according to the comparative example.

According to the rotation transmission structure 100 of this exemplary embodiment, since the external gear shaft 124 is rotated as described above as the photoreceptor 31 is moved to the apparatus body side, a force required to fit the external gear shaft 124 to the gear G1 is smaller than that in the comparative example shown in FIGS. 6A and 6B.

Further, according to the rotation transmission structure 100 of this exemplary embodiment, the external gear shaft 124 is rotated as the plurality of inclined internal teeth 128A and inclined external teeth 124B arranged in the circumferential direction are moved relative to each other in the axial direction. For this reason, according to the rotation transmission structure 100, poor fitting between the external gear shaft 124 and the gear G1 is suppressed as compared to a case where a rotation mechanism is formed of one inclined tooth and protrusions corresponding to the inclined tooth.

Furthermore, according to the rotation transmission structure 100 of this exemplary embodiment, the external gear shaft 124 is rotated by the ½ pitch of the straight external teeth 124A as the photoreceptor 31 is moved to the apparatus body side by a moving stroke $L_2$ from an interference point between the gear G1 and the external gear shaft 124. For this reason, according to the rotation transmission structure 100, poor fitting between the external gear shaft 124 and the gear G1 is suppressed as compared to a case where the external gear shaft 124 is rotated by only the ¼ pitch of the straight external teeth 124A as the photoreceptor 31 is moved to the apparatus body side by a moving stroke S ($>L_2$) from an interference point between the gear G1 and the external gear shaft 124.

Moreover, according to the rotation transmission structure 100 of this exemplary embodiment, the rotation of the output gear 122 (motor M1) is transmitted to the external gear shaft 124 since the inclined internal teeth 128A and the inclined external teeth 124B mesh with each other. For this reason, according to the rotation transmission structure 100, the number of components is reduced as compared to a case where a member for transmitting the rotational drive force of the motor M1 to the external gear shaft 124 is provided in addition to the inclined internal teeth 128A and the inclined external teeth 124B.

Further, according to the rotation transmission structure 100 of this exemplary embodiment, an axial force in a direction protruding from the internal toothed hole 128 acts on the external gear shaft 124 in a case where the rotational drive force of the motor M1 acts. For this reason, according to the rotation transmission structure 100, disconnection between the gear G1 and the external gear shaft 124 in the axial direction in a case where a rotational drive force acts is suppressed as compared to a case where a force in a direction opposite to a direction protruding from the output gear 122 is generated on the external gear shaft 124.

Furthermore, according to the image forming apparatus 1 of this exemplary embodiment, a force required for the mounting (rotatable connection) of the photoreceptor 31 on the apparatus body is smaller than that in a case where the drive force transmission device 200 according to the comparative example shown in FIGS. 6A and 6B is provided.

In the rotation transmission structure 100 according to this exemplary embodiment, the external gear shaft 124 and the gear G1 can be fitted to each other in a case where the external gear shaft 124 is moved by $L_2$ in the axial direction as shown in FIG. 2B. Accordingly, a space having a dimension $L_3$ in the axial direction between the end portion of the external gear shaft 124 facing the apparatus body and the bottom 128B is not necessarily required as long as the coil spring 130 can be disposed. For this reason, in a case where the dimension of the output gear 122 in the axial direction is reduced without the space having the dimension Lar the dimension of the image forming apparatus 1 in a direction along the axial direction of the output gear 122 is reduced. As a result, the size of the image forming apparatus 1 can be reduced.

Further, the tapered portion 124D, which allows the external gear shaft 124 to easily enter the gear G1, is formed at the corner of the distal end of the external gear shaft 124. However, in the rotation transmission structure 100 according to this exemplary embodiment, the external gear shaft 124 is rotated, so that the external gear shaft 124 and the gear G1 can be easily fitted to each other. The tapered portion 124D may be provided as necessary or may not be provided. In a case where the external gear shaft 124 is shortened by the axial length L of the tapered portion 124D, the size of the image forming apparatus 1 can be further reduced.

OTHER EXEMPLARY EMBODIMENTS

The exemplary embodiment of the present disclosure has been described above. However, it is natural that the present disclosure is not limited thereto and may be embodied in the form of various modifications without departing from the scope of the present disclosure in addition to the exemplary embodiment described above.

In the exemplary embodiment, the inclined external teeth 124B have been provided on the apparatus body side of the external gear shaft 124 and the inclined external teeth 124B have been adapted to be inserted into the internal toothed hole 128 of the output gear 122. However, the internal toothed hole 128 may be provided on the apparatus body side of the external gear shaft 124 and a shaft portion provided with the inclined external teeth 124B may be formed on the output gear 122.

In the rotation transmission structure 100 according to the exemplary embodiment, the external gear shaft 124 has been adapted to be rotated using the rotation mechanism, which is formed of the inclined external teeth 124B of the external gear shaft 124 and the inclined internal teeth 128A of the output gear 122, in a case where the external gear shaft 124 is moved in the axial direction. However, the external gear shaft 124 may be adapted to be rotated by another rotation mechanism that does not use the inclined external teeth 124B and the inclined internal teeth 128A. For example, a rotation mechanism in which an inclined groove inclined with respect to the axial direction is formed on any one of the external gear shaft 124 or the output gear 122 and a pin to be inserted into the inclined groove and to slide is provided on the other of the external gear shaft 124 or the output gear 122 may be used.

The inclined external teeth 124B of the external gear shaft 124 and the inclined internal teeth 128A of the output gear 122 of the exemplary embodiment may be inclined in a direction opposite to the direction shown in FIGS. 2A, 2B, and 3.

In the rotation transmission structure 100 according to the exemplary embodiment, the photoreceptor drum 31 has been an example of the moving body of the present disclosure. However, a rotational drive force from the apparatus body has only to be transmitted to the moving body, and the moving body may be a component (the developing roller 42 of the developing device 40, or the like) other than the photoreceptor drum 31.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A rotation transmission structure comprising:

a first member that is provided on a rotating body and includes a plurality of straight teeth extending in an axial direction of the rotating body and arranged in a circumferential direction;

a second member that is provided on a moving body moving in the axial direction of the rotating body, includes a plurality of straight teeth extending in the axial direction of the rotating body and arranged in the circumferential direction, and is fitted to the first member to transmit rotation of the rotating body to the moving body in a case where the moving body approaches the rotating body;

a biasing member that biases the first member toward the moving body; and a rotation mechanism that is provided between the first member and the rotating body and rotates the first member in a case where the first member is moved toward the rotating body, wherein the rotation mechanism includes an externally toothed member that includes a plurality of inclined teeth inclined with respect to the axial direction and arranged in the circumferential direction, and an internally toothed member that includes a plurality of inclined teeth inclined with respect to the axial direction and arranged in the circumferential direction and is fitted to the externally toothed member.

2. The rotation transmission structure according to claim 1, wherein the inclined teeth of the externally toothed member and the inclined teeth of the internally toothed member are inclined with respect to the axial direction so that the straight teeth of the first member are rotated by ½ pitch of the straight teeth of at least the first member in a case where the first member is moved in the axial direction.

3. The rotation transmission structure according to claim 1, wherein the rotation mechanism also serves as a transmission mechanism that transmits a rotational drive force of a motor, which acts on the rotating body, to the second member of the moving body.

4. The rotation transmission structure according to claim 2, wherein the rotation mechanism also serves as a transmission mechanism that transmits a rotational drive force of a motor, which acts on the rotating body, to the second member of the moving body.

5. The rotation transmission structure according to claim 3, wherein the inclined teeth of the externally toothed member and the inclined teeth of the internally toothed member are inclined so that a force in a direction protruding from the rotating body is generated on the first member in a case where the rotational drive force acts.

6. The rotation transmission structure according to claim 4, wherein the inclined teeth of the externally toothed member and the inclined teeth of the internally toothed member are inclined so that a force in a direction protruding from the rotating body is generated on the first member in a case where the rotational drive force acts.

7. An image forming apparatus comprising:

a moving body that forms an image forming unit;

a rotating body that is provided in an apparatus body and is connected to a drive source; and the rotation transmission structure according to claim 1 that transmits rotation of the rotating body to the moving body.

8. An image forming apparatus comprising:

a moving body that forms an image forming unit;

a rotating body that is provided in an apparatus body and is connected to a drive source; and the rotation transmission structure according to claim 2 that transmits rotation of the rotating body to the moving body.

9. An image forming apparatus comprising:

a moving body that forms an image forming unit;

a rotating body that is provided in an apparatus body and is connected to a drive source; and the rotation transmission structure according to claim 3 that transmits rotation of the rotating body to the moving body.

10. An image forming apparatus comprising:

a moving body that forms an image forming unit;

a rotating body that is provided in an apparatus body and is connected to a drive source; and the rotation transmission structure according to claim 4 that transmits rotation of the rotating body to the moving body.

11. An image forming apparatus comprising:

a moving body that forms an image forming unit;

a rotating body that is provided in an apparatus body and is connected to a drive source; and the rotation transmission structure according to claim 5 that transmits rotation of the rotating body to the moving body.

12. An image forming apparatus comprising:

a moving body that forms an image forming unit;

a rotating body that is provided in an apparatus body and is connected to a drive source; and the rotation transmission structure according to claim 6 that transmits rotation of the rotating body to the moving body.

* * * * *